US007334523B2

(12) United States Patent
Lucas et al.

(10) Patent No.: US 7,334,523 B2
(45) Date of Patent: Feb. 26, 2008

(54) FUZE WITH ELECTRONIC STERILIZATION

(75) Inventors: James D. Lucas, Chanhassen, MN (US); Dennis L. Kurschner, Minnetonka, MN (US)

(73) Assignee: Alliant Techsystems Inc., Edina, MN (US)

( * ) Notice: Subject to any disclaimer, the term of this patent is extended or adjusted under 35 U.S.C. 154(b) by 432 days.

(21) Appl. No.: 10/929,931

(22) Filed: Aug. 30, 2004

(65) Prior Publication Data

US 2006/0042494 A1 Mar. 2, 2006

(51) Int. Cl.
*F42C 19/00* (2006.01)

(52) U.S. Cl. ..... 102/202.7; 102/215; 102/218; 102/206

(58) Field of Classification Search ..... 102/215, 102/218, 206, 262, 265, 202.7, 202.1, 202.5; 361/248, 249, 251
See application file for complete search history.

(56) References Cited

U.S. PATENT DOCUMENTS

| | | | | |
|---|---|---|---|---|
| 4,095,527 | A * | 6/1978 | Moore, III | 102/426 |
| 4,541,341 | A | 9/1985 | Fowler et al. | 102/215 |
| 4,602,565 | A | 7/1986 | McDonald et al. | 102/207.7 |
| 4,641,801 | A | 2/1987 | Lynch, Jr. et al. | 244/3.14 |
| 4,691,105 | A | 9/1987 | Huffnagle | 250/338 |
| 4,796,532 | A | 1/1989 | Webb | 102/233 |
| 4,893,564 | A * | 1/1990 | Ochi et al. | 102/218 |
| 4,920,884 | A * | 5/1990 | Haglund et al. | 102/215 |
| 5,396,845 | A | 3/1995 | Backstein et al. | 102/427 |
| 5,444,598 | A | 8/1995 | Aresco | 361/253 |
| 5,497,704 | A | 3/1996 | Kurschner et al. | 102/264 |
| 5,600,293 | A | 2/1997 | Hunter | 336/182 |
| 5,641,935 | A | 6/1997 | Hunter et al. | 102/206 |
| 5,693,906 | A | 12/1997 | Van Sloun | 102/251 |
| 5,705,766 | A | 1/1998 | Farace et al. | 102/206 |
| 6,196,130 | B1 | 3/2001 | Crist et al. | 102/221 |
| 6,253,679 | B1 | 7/2001 | Woodall et al. | 102/221 |
| 6,295,931 | B1 | 10/2001 | Cutler et al. | 102/221 |
| 6,295,932 | B1 | 10/2001 | Kane, III | 102/221 |
| 6,363,852 | B1 * | 4/2002 | Huhmann et al. | 102/202.5 |

OTHER PUBLICATIONS

Fairchild Semiconductor™ *Introduction to Power MOSFETs and their Applications*, Application Note 558, Ralph Locher, RevB, Oct. 1998.

National Semiconductor, Application Note 4, Apr. 1968, *Monolithic Op Amp-The Universal Linear Component*, Robert J. Widlar, pp. 1-10.

Fairchild Semiconductor™ AN9010, Dated Nov. 2, 1999, *MOSFET Basics*, Apr. 1999, R&D 2 Group Fairchild Korea Semiconductor, pp. 1-36.

Integrated Circuits, Application Note, AN165, *Integrated operational amplifier theory*, pp. 1-10, dated Dec. 1988, Phillips Semiconductors.

* cited by examiner

*Primary Examiner*—James S Bergin
(74) *Attorney, Agent, or Firm*—Vidas, Arrett & Steinkraus, P.A.

(57) ABSTRACT

A fuze may include a detonator, a firing capacitor and a control circuit. The firing capacitor may be charged to a nominal operational voltage, wherein when the firing capacitor is discharged across the detonator, an external explosive charge may be detonated. The firing capacitor may also be charged to a sterilization voltage, wherein when the firing capacitor is discharged across the detonator, the detonator may be destroyed without causing detonation of an external explosive charge. When the detonator is destroyed, the sterilized fuze is unable to trigger detonation of an external explosive charge.

22 Claims, 2 Drawing Sheets

FUZE WITH ELECTRONIC STERILIZATION

BACKGROUND OF THE INVENTION

This invention relates to electronic fuzes for controlling the detonation of weapons and munitions. Fuzes may include a Safety and Arming (S & A) device or subsystem for controlling high order detonation of an explosive device external to the fuze, such as a warhead or mine. A fuze may generally detect a number of conditions before arming and high order detonation. For example, a fuze may detect proper deployment before arming. In some embodiments, fuzes may be capable of detecting launch, flight, safe separation, elapsed mission time, turns-to-burst, and the like.

The S & A device desirably keeps the fuze in a safe or unarmed mode until various conditions have been satisfied, whereinafter the fuze may become armed and ready to trigger detonation of an external explosive charge.

In certain situations, it may be desirable to permanently disable or "sterilize" the fuze. Desirably, a sterilized fuze is permanently unable to detonate an external explosive charge.

Prior art mechanical S & A devices generally employ a mechanical interruption between the fuze detonator and the warhead while in a safe mode. Mechanical interruption may be accomplished by physical barriers, rotation or misalignment between the fuze detonator and the warhead. Upon fuze arming, the mechanical interruption is removed and initiation of the fuze detonator will cause high order detonation of the warhead. For example, an electromechanical S & A device is disclosed in U.S. Pat. No. 5,693,906 to Van Sloun, the entire disclosure of which is incorporated herein by reference.

Fuzes having a mechanical S & A device have generally accomplished sterilization by initiating the fuze detonator while the mechanical interruption is in place. Thus, due to a barrier or misalignment, shock from the detonator is interrupted from reaching the high explosive or external explosive charge. The fuze becomes sterilized because the fuze detonator has been permanently destroyed without causing detonation of the high explosive.

Many present day fuze designs omit mechanical S & A technology, as the moving parts of a mechanical system can degrade, corrode, bind and experience other problems that can lead to failure or improper operation. Further, Fuzes having a mechanical S & A device are generally unable to be armed and disarmed remotely. Thus, the S & A device of a present day fuze may be a solid state device that is purely electronic in operation. Electronic fuzes are generally electronically controllable, and thus may be armed and disarmed via a remote command signal, such as a radio-frequency interface. However, because an electronic fuze is generally a solid state device, the fuze detonator is permanently in-line with the warhead. Thus, sterilization as accomplished in mechanical fuzes is not possible.

There remains a need for an electronic fuze having a sterilization function.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

It is an object of the invention to provide an electronic fuze having a sterilization function.

It is an object of the invention to provide an electronic fuze wherein the fuze detonator may be destroyed without causing high order detonation of an external explosive charge.

In one embodiment, an electronic fuze having a sterilization function may comprise an exploding foil initiator having a foil bridge and an explosive, a firing capacitor and a control circuit. The control circuit may be arranged to charge the firing capacitor and to discharge the charged firing capacitor across the exploding foil initiator. The control circuit may charge the capacitor to a sterilization voltage, wherein when the capacitor is discharged across the exploding foil initiator, the foil bridge is destroyed without causing detonation of the explosive. The control circuit may further be arranged to charge the capacitor to a nominal operational voltage, wherein when the capacitor is discharged across the exploding foil initiator, the explosive is detonated.

In another embodiment, an electronic fuze having a sterilization function may comprise a firing capacitor, a detonator having an explosive and a logic control circuit arranged to control a high voltage circuit and a trigger circuit. The high voltage circuit may be arranged to charge the firing capacitor, and when the trigger circuit is activated, the firing capacitor may discharge across the detonator. The high voltage circuit may charge the firing capacitor to a sterilization voltage, wherein when the firing capacitor discharges across the detonator, the detonator is destroyed without causing detonation of the explosive. The high voltage circuit may further charge the firing capacitor to a nominal operational voltage, wherein when the firing capacitor discharges across the detonator, the explosive is detonated.

In another embodiment, an electronic fuze having a sterilization function may comprise an exploding foil initiator and a control circuit having a first state and a second state. In the first state, the control circuit may provide a nominal voltage to the exploding foil initiator. In the second state, the control circuit may provide a sterilization voltage to the exploding foil initiator. When the nominal voltage is provided to the exploding foil initiator, the bridge foil of the initiator may be vaporized, and the flyer may be propelled into an explosive. When the sterilization voltage is provided to the exploding foil initiator, the bridge foil may be deflagrated without propelling the flyer into the explosive, thereby rendering the fuze sterilized without detonating the explosive.

In another embodiment, a method of sterilizing an electronic fuze may comprise providing an electronic fuze having a firing capacitor and an exploding foil initiator, the exploding foil initiator having an explosive and a maximum acceptable safe stimulus level. The method may further comprise charging the firing capacitor to a predetermined voltage level that is less than the maximum acceptable safe stimulus level, and discharging the firing capacitor across the exploding foil initiator to destroy the exploding foil initiator without causing detonation of the explosive.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
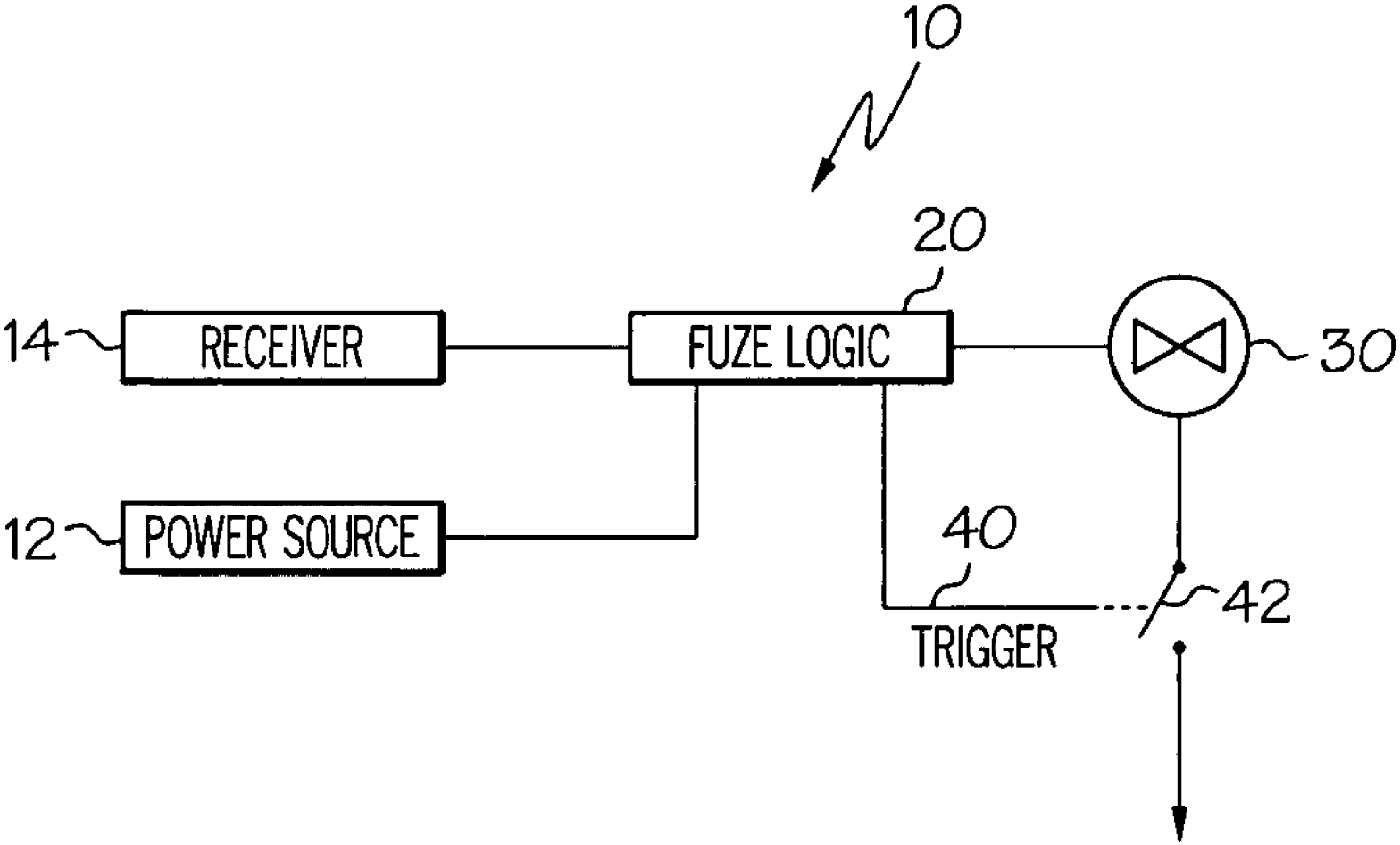
FIG. 1 is a schematic diagram of one embodiment of a sterilizable fuze.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

In one embodiment, the invention comprises a sterilizable electronic fuze. The fuze may control the operation of a detonator, such as an exploding foil initiator. The fuze may include a normal detonation function, wherein upon detonation of the detonator, an external high-order explosive is detonated. The fuze may also include a sterilization function, wherein the detonator is destroyed without causing the external high-order explosive to detonate, rendering the fuze unable to trigger future detonation of the external high-order explosive. The normal detonation function may be achieved by providing the detonator with a first or nominal voltage and triggering the detonator. The sterilize function may be achieved by providing the detonator with a second or sterilization voltage and triggering the detonator. Desirably the sterilization voltage is less than the nominal voltage. Further, the nominal voltage desirably results in the detonator receiving an amount of energy that is above the maximum acceptable safe stimulus energy level for the detonator, while the sterilization voltage desirably results in the detonator receiving an amount of energy that is below the maximum acceptable safe stimulus energy level.

FIG. 1 shows a schematic diagram of an embodiment of a sterilizable electronic fuze 10. The fuze 10 may include a logic circuit 20, a power source 12, a trigger circuit 40 having a switch 42 and a detonator 30. A detonator 30 may have a predetermined maximum acceptable safe stimulus (MASS) level, wherein initiation of the detonator 30 at or below the MASS level will not cause high-order detonation of an associated munition or warhead. A MASS level may refer to characteristics such as current, rate of change of current, power, voltage, or energy levels.

A detonator 30 may comprise an exploding foil initiator, for example as disclosed in U.S. Pat. No. 4,602,565 to MacDonald et al., the entire disclosure of which is hereby incorporated by reference. An exploding foil initiator may include a foil bridge, a flyer and an internal high-explosive pellet.

The fuze 10 may further include a receiver 14, such as a radio-frequency receiver, which may receive an instruction signal and relay the instruction signal to the logic circuit 20. An instruction signal may be used to switch the fuze 10 between normal detonation and sterilization functions.

The fuze 10 may operate in a normal operation mode, wherein the detonator 30 may be provided with a first or nominal voltage. Desirably, the first or nominal voltage supplied to the detonator 30 will result in the detonator 30 experiencing a stimulus that is above the MASS level upon initiation of the trigger circuit 40. Thus, when the fuze 10 is operating in a normal operation mode, upon initiation of the trigger circuit 40, the resulting stimulus to the detonator 30 may cause high-order detonation of an external explosive charge associated with the fuze 10. When the detonator 30 comprises an exploding foil initiator, the nominal voltage stimulus supplied to the detonator 30 may cause the foil bridge of the exploding foil initiator to vaporize, shearing the flyer and causing it to impact and detonate the internal high-explosive pellet. Upon detonation of the internal high-explosive pellet, the external explosive charge may also detonate.

The fuze 10 may further operate in a sterilization mode, wherein the detonator 30 may be provided with a second or sterilization voltage. Desirably, the second or sterilization voltage supplied to the detonator 30 will result in the detonator 30 experiencing a stimulus that is below the MASS level upon initiation of the trigger circuit 40. Thus, when the fuze 10 is operating in a sterilization mode, upon initiation of the trigger circuit 40, the resulting stimulus to the detonator 30 may cause destruction of the detonator 30 without causing high-order detonation of an external explosive charge associated with the fuze 10. When the detonator 30 comprises an exploding foil initiator, the sterilization voltage stimulus supplied to the detonator 30 may cause deflagration of the foil bridge without causing detonation of the internal high-explosive pellet or the external explosive charge. In some embodiments, the sterilization voltage stimulus supplied to the detonator 30 may cause deflagration of the foil bridge without shearing the flyer of the exploding foil initiator.

After a sterilization function is performed, the fuze 10 may no longer have an operational detonator 30. Thus, sterilization may render the fuze 10 permanently inoperable for the purpose of detonating an associated external explosive charge.

A control device or command station may instruct a fuze 10 to perform a sterilization function. For example, a sterilization command may be transmitted from the control device or command station, such as by radio-frequency signal, and received by a receiver 14 in the fuze 10. The receiver 14 may relay the instruction to the fuze logic circuit 20, and the fuze logic circuit 20 may control the voltage provided to the detonator to the sterilization voltage, and may initiate operation of the trigger circuit 40.

When instructing a fuze 10 to perform a sterilize function, each fuze 10 may be individually controlled and may have a unique sterilization code. Thus, a fuze 10 may be arranged to perform sterilization only when it receives a predetermined security code or signal.

In some embodiments, a fuze 10 may include a plurality of detonators 30. Each detonator 30 may be arranged for independent sterilization. Thus, a fuze 10 may perform a sterilization function on a first detonator, and may still be able to achieve high-order detonation of an external explosive charge using a second detonator. The logic circuit 20 of the fuze 10 may require independent security codes or signals for each detonator 30.

Figure 2:
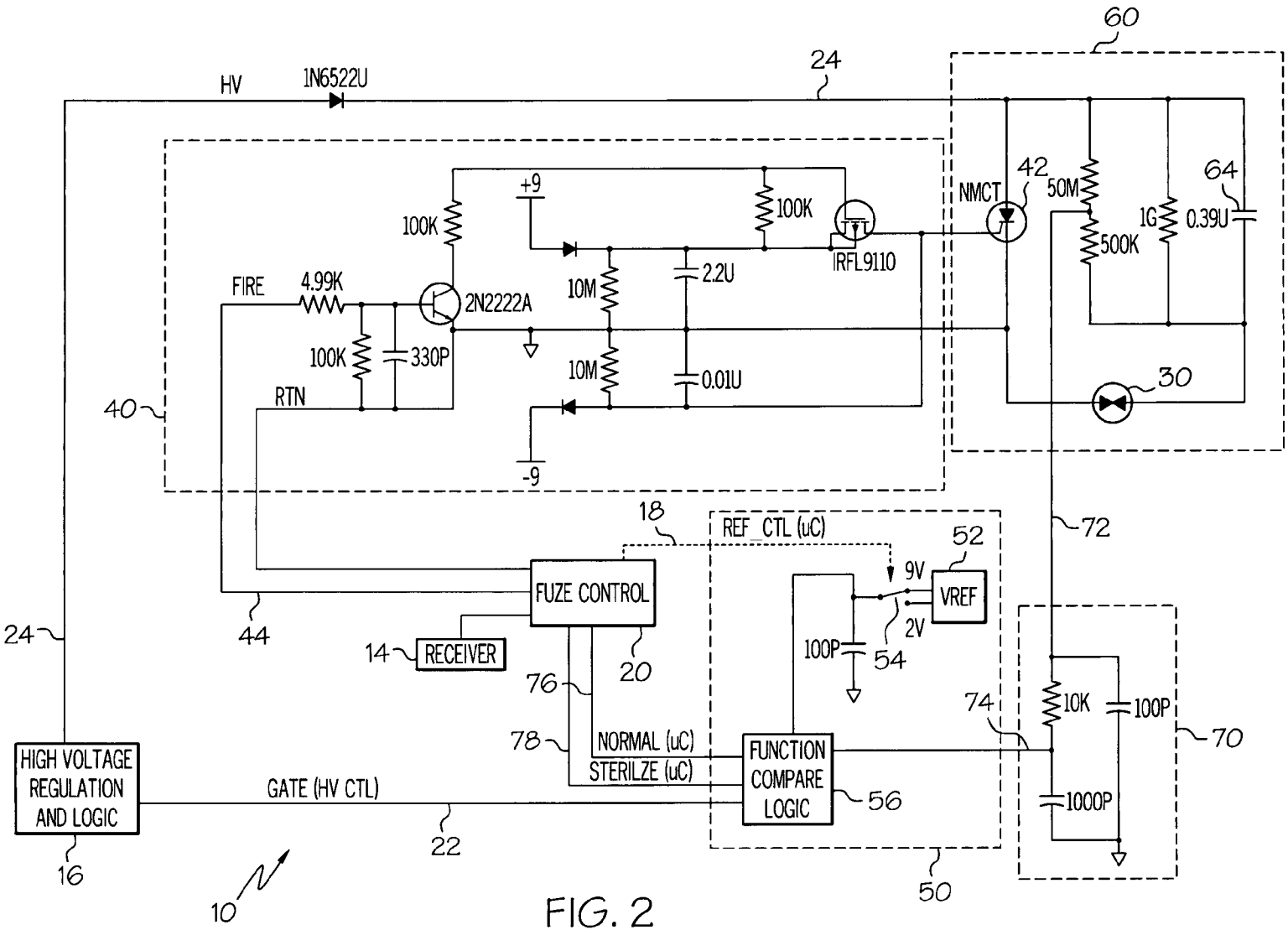
FIG. 2 is a schematic diagram of another embodiment of a sterilizable fuze.

FIG. 2 shows another embodiment of a sterilizable electronic fuze 10. The fuze 10 may include a logic control circuit 20, a receiver 14, a mode or function selection circuit 50, a high voltage regulation and logic circuit 16, a trigger circuit 40, a capacitive discharge circuit 60 and a feedback circuit 70. A detonator 30, such as an exploding foil initiator, may be included in the capacitive discharge circuit 60.

The logic control circuit 20 may control the operation of the fuze 10 and may select between normal and sterilize functions via a reference control line 18. The function selection circuit 50 may comprise a reference voltage source 52, a function switch 54 and a function compare logic circuit 56. The reference voltage source 52 is desirably arranged to provide a reference voltage comprising two voltage output levels: a first reference or nominal reference voltage and a second reference or sterilize reference voltage. For example, a nominal reference voltage may be 9 volts, and a sterilize reference voltage may be 2 volts. In another embodiment, a nominal reference voltage may be 9 volts, and a sterilize reference voltage may comprise an absence of voltage or 0 volts. In another embodiment, a nominal reference voltage may comprise an absence of voltage or 0 volts, and a sterilize reference voltage may be any voltage greater than 0 volts.

The function switch 54 may be arranged to provide the function compare logic circuit 56 with the reference voltage output of the reference voltage source 52. The function switch 54 may be controlled by the reference control line 18 from the logic control circuit 20, and may selectively provide either the nominal reference voltage or the sterilize reference voltage from the reference voltage source 52 to the function compare logic circuit 56. For example, the function switch 54 may comprise a relay arranged to provide the nominal reference voltage to the function compare logic circuit 56 while at rest. Upon the application of a voltage to the reference control line 18, the switch may throw, thereby providing the function compare logic circuit 56 with the sterilization reference voltage.

The function compare logic circuit 56 may receive the reference voltage and interpret the desired normal operation or sterilize command. The function compare logic circuit 56 may control the high voltage regulation and logic circuit 16 via a GATE or high voltage control line 22. When the function compare logic circuit 56 receives a nominal reference voltage from the reference voltage source 52, it may instruct the high voltage regulation and logic circuit 16 via the GATE signal 22 to provide a first or nominal voltage to a high voltage output line 24. When the function compare logic circuit 56 receives a sterilization reference voltage from the reference voltage source 52, it may instruct the high voltage regulation and logic circuit 16 via the GATE signal 22 to provide a second or sterilize voltage to the high voltage output line 24. For example, the high voltage regulation and logic circuit 16 may provide a nominal voltage of 1200 volts or a sterilization voltage of 500 volts to the high voltage output line 24.

The capacitive discharge circuit 60 may include a firing switch 42, a firing capacitor 64 and the detonator 30. The high voltage output line 24 may be connected to the firing capacitor 64 and may charge the firing capacitor 64 to the voltage being applied to the high voltage output line 24. The firing switch 42, firing capacitor 64 and detonator 30 may be arranged such that when the firing switch 42 is activated, the charged firing capacitor 64 may discharge across the detonator 30.

The detonator 30 may have a predetermined maximum acceptable safe stimulus (MASS) level and may be arranged to detonate an external explosive charge under certain conditions. Desirably, when the firing capacitor 64 is charged to the nominal voltage, the resulting stimulus applied to the detonator 30 will be greater than the MASS level, and the resulting detonation of the detonator 30 will cause detonation of the external explosive charge. Desirably, when the firing capacitor 64 is charged to the sterilization voltage, the resulting stimulus applied to the detonator 30 will be less than the MASS level, and deflagration of the detonator 30 will not cause detonation of the external explosive charge.

The firing switch 42 may be controlled by the trigger circuit 40, which may in turn be controlled by the control logic circuit 20. When initiation of the detonator 30 is desired, the control logic circuit 20 may apply a voltage to a fire lead 44, which may cause the trigger circuit 40 to activate the firing switch 42. An embodiment of a trigger circuit 40 is shown in FIG. 2. Operation of the trigger circuit 40 would be understood by a person of ordinary skill in the art and is not discussed in detail.

In some embodiments, the firing switch 42 may comprise an N-channel MOS-controlled Thyristor (MCT). Upon receiving the fire instruction from the logic control circuit 20 via a voltage on the fire lead 44, the trigger circuit 40 may apply a voltage to the gate terminal 62 of the thyristor 42, allowing voltage to pass through the thyristor 42 and allowing the capacitor 64 to discharge across the detonator 30.

The feedback circuit 70 may monitor the voltage of the firing capacitor 64 via a feedback input line 72 and provide feedback to the function selection circuit 50 via a feedback output line 74. The function compare logic circuit 56 may receive the output line 74 from the feedback circuit 70 and verify that the appropriate nominal or sterilization voltage has reached the firing capacitor 64. The function compare logic circuit 56 may relay the firing capacitor 64 voltage information to the control logic circuit 20 by placing a voltage on either a normal function verification line 76 or a sterilization function verification line 78. If the firing capacitor 64 is charged to the nominal voltage, the function compare logic circuit 56 may place a voltage on the normal function verification line 76. If the firing capacitor 64 is charged to the sterilization voltage, the function compare logic circuit 56 may place a voltage on the sterilization function verification line 78.

Operation of the fuze 10 during the normal operation and sterilization function will now be discussed.

During normal operation, the control logic circuit 20 may control the function switch 54 via the reference control line 18, causing the nominal reference voltage from the reference voltage source 52 to reach the function compare logic circuit 56. The function compare logic circuit 56 receives the nominal reference voltage indicating normal operation and places an appropriate signal on the GATE signal 22 to instruct the high voltage regulation and logic circuit 16 to place a nominal voltage, such as 1200 volts, on the high voltage output line 24. The nominal voltage reaches and charges the firing capacitor 64.

The feedback circuit 70 may measure the voltage of the firing capacitor 64 and provide a voltage to the function compare logic circuit 56 indicating that the firing capacitor 64 is charged to the nominal voltage. The function compare logic circuit 56 may indicate to the control logic circuit 20 that the firing capacitor 64 is charged to the nominal voltage by placing a voltage on the normal function verification line 76. The fuze 10 is then arranged to cause detonation of an external explosive charge upon the application of a firing pulse to the trigger circuit 40.

The fuze 10 may include a receiver 14, such as a radio-frequency receiver. The fuze 10 may receive a detonation instruction from an external control or command unit. In some embodiments, the fuze 10 may include an additional sensor (not shown), which may be used to provide a detonation instruction. For example, an additional sensor may be a proximity sensor, pressure switch or the like.

Upon receiving a detonation instruction from the receiver 14, a sensor or some other appropriate source, the logic control circuit 20 may activate the trigger circuit 40 by placing a voltage on the fire lead 44, thereby activating the firing switch 42 and causing the firing capacitor 64 to discharge across the detonator 30. Desirably, the stimulus provided to the detonator 30 while functioning in a normal operation mode will be higher than the predetermined MASS level for the detonator 30, and will therefore cause detonation of an external explosive charge. In an embodiment where the detonator 30 comprises an exploding foil initiator, the nominal voltage stimulus supplied to the detonator 30 may cause the foil bridge of the exploding foil initiator to vaporize, shearing the flyer and causing it to impact and detonate an internal high-explosive pellet. Upon detonation of an internal high-explosive pellet, the external explosive charge may also detonate.

During a sterilization operation, the logic control circuit 20 may receive a sterilization instruction from an external source. For example, an external control or command unit may send a sterilize instruction which may be received by the receiver 14. The control logic circuit 20 may control the function switch 54 via the reference control line 18, causing the sterilization reference voltage from the reference voltage source 52 to reach the function compare logic circuit 56. The function compare logic circuit 56 receives the sterilization reference voltage indicating the sterilization function and places an appropriate signal on the GATE 22 to instruct the high voltage regulation and logic circuit 16 to place a sterilization voltage, such as 500 volts, on the high voltage output line 24. The sterilization voltage reaches and charges the firing capacitor 64.

The feedback circuit 70 may measure the voltage of the firing capacitor 64 and provide a voltage to the function compare logic circuit 56 indicating that the firing capacitor 64 is charged to the sterilization voltage. The function compare logic circuit 56 may indicate to the control logic circuit 20 that the firing capacitor 64 is charged to the sterilization voltage by placing a voltage on the sterilization function verification line 78. The fuze 10 is then arranged to cause sterilization by destroying the detonator 30 upon the application of a firing pulse to the trigger circuit 40 without causing detonation of an external explosive charge.

Upon sensing voltage on the sterilization function verification line 78, and thus receiving an indication that the firing capacitor 64 charged to the sterilization voltage and arranged for sterilization, the control logic circuit 20 may activate the trigger circuit 40 by placing a voltage on the fire lead 44, thereby activating the firing switch 42 and causing the firing capacitor 64 to discharge across the detonator 30. Desirably, the stimulus provided to the detonator 30 while functioning in a sterilization mode will be less than the predetermined MASS level for the detonator 30. The stimulus provided to the detonator 30 may destroy the detonator 30 without causing detonation of an external explosive charge. When the detonator 30 comprises an exploding foil initiator, the sterilization voltage stimulus supplied to the detonator 30 may cause deflagration of the foil bridge without causing detonation of the internal high-explosive pellet or the external explosive charge. In some embodiments, the sterilization voltage stimulus supplied to the detonator 30 may cause deflagration of the foil bridge without shearing the flyer of the exploding foil initiator.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fuze comprising:

an exploding foil initiator comprising a foil bridge and an explosive;

a firing capacitor; and a control circuit arranged to charge the firing capacitor and to discharge the firing capacitor across the exploding foil initiator;

wherein the control circuit charges the capacitor to a sterilization voltage, and when the capacitor is discharged across the exploding foil initiator, the foil bridge is destroyed without causing detonation of the explosive.

2. The fuze of claim 1, wherein the control circuit is arranged to charge the capacitor to a nominal operational voltage, and when the capacitor is discharged across the exploding foil initiator, the explosive is detonated.

3. The fuze of claim 1, wherein the exploding foil initiator has a predetermined maximum acceptable safe stimulus level, and when the firing capacitor is charged to the sterilization voltage and discharged across the exploding foil initiator, the stimulus provided to the exploding foil initiator is less than the predetermined maximum acceptable safe stimulus level.

4. The fuze of claim 1, wherein the exploding foil initiator has a predetermined maximum acceptable safe stimulus level, and when the firing capacitor is charged to a nominal operational voltage and discharged across the exploding foil initiator, the stimulus provided to the exploding foil initiator is greater than the predetermined maximum acceptable safe stimulus level.

5. A fuze comprising:

a firing capacitor;

a detonator having an explosive; and a logic control circuit arranged to control a high voltage circuit and a trigger circuit;

wherein the high voltage circuit is arranged to charge the firing capacitor, and when the trigger circuit is activated, the firing capacitor discharges across the detonator; and wherein the high voltage circuit is arranged to charge the firing capacitor to a sterilization voltage, and when the firing capacitor discharges across the detonator at the sterilization voltage, the detonator is destroyed without causing detonation of the explosive.

6. The fuze of claim 5, wherein the high voltage circuit is arranged to charge the firing capacitor to a nominal operational voltage, and when the firing capacitor discharges across the detonator at the nominal operational voltage, the explosive is detonated.

7. The fuze of claim 6, further comprising a feedback circuit which indicates to the logic circuit the voltage of the firing capacitor.

8. The fuze of claim 7, wherein the feedback circuit further comprises a normal voltage verification line.

9. The fuze of claim 7, wherein the feedback circuit further comprises a sterilization voltage verification line.

10. The fuze of claim 6, wherein the logic control circuit further comprises reference voltage source, a reference voltage receiving circuit controlling the high voltage circuit, and a switch controlled by the logic circuit;

wherein at a first switch position, the reference voltage source is arranged to output a first reference voltage to the reference voltage receiving circuit, and the reference voltage receiving circuit instructs the high voltage circuit to provide the nominal operational voltage to the firing capacitor; and wherein at a second switch position, the reference voltage source is arranged to output a second reference voltage to the reference voltage receiving circuit, and the reference voltage receiving circuit instructs the high voltage circuit to provide the sterilization voltage to the firing capacitor.

11. The fuze of claim 6, wherein the trigger circuit activates a firing switch that shorts the firing capacitor across the detonator.

12. The fuze of claim 11, wherein the firing switch comprises an n-channel MOS-controlled thyristor.

13. The fuze of claim 5, wherein the detonator comprises an exploding foil initiator.

14. The fuze of claim 13, wherein the exploding foil initiator has a predetermined maximum acceptable safe stimulus level, and when the firing capacitor is charged to the sterilization voltage and discharged across the exploding foil initiator, the stimulus provided to the exploding foil initiator is less than the predetermined maximum acceptable safe stimulus level.

15. The fuze of claim 13, wherein the exploding foil initiator has a predetermined maximum acceptable safe stimulus level, and when the firing capacitor is charged to the nominal operational voltage and discharged across the exploding foil initiator, the stimulus provided to the exploding foil initiator is greater than the predetermined maximum acceptable safe stimulus level.

16. The fuze of claim 5, further comprising a receiver in communication with the logic circuit which receives a sterilization instruction.

17. A fuze for an explosive, the fuze comprising:

an exploding foil initiator; and a control circuit having a first state and a second state;

wherein in the first state, the control circuit provides a nominal voltage to the exploding foil initiator, the nominal voltage being sufficient to detonate the explosive, and in the second state, the control circuit provides a sterilization voltage to the exploding foil initiator, the sterilization voltage being sufficient to destroy the exploding foil initiator without causing detonation of the explosive.

18. The fuze of claim 17, wherein the exploding foil initiator comprises a bridge foil, a flyer and an explosive.

19. The fuze of claim 18, wherein when the nominal voltage is provided to the exploding foil initiator, the bridge foil is vaporized, and a portion of the flyer is propelled into the explosive.

20. The fuze of claim 18, wherein when the sterilization voltage is provided to the exploding foil initiator, the bridge foil is deflagrated without propelling the flyer into the explosive.

21. The fuze of claim 20, wherein the explosive is not detonated.

22. A method of sterilizing an electronic fuze comprising:

providing an electronic fuze having a firing capacitor and an exploding foil initiator, the exploding foil initiator having an explosive and a maximum acceptable safe stimulus level;

charging the firing capacitor to a predetermined voltage level that is less than the maximum acceptable safe stimulus level;

discharging the firing capacitor across the exploding foil initiator to destroy the exploding foil initiator without causing detonation of the explosive.

* * * * *